US012497890B2

(12) United States Patent
Goodman et al.

(10) Patent No.: US 12,497,890 B2
(45) Date of Patent: Dec. 16, 2025

(54) HYDRO-MECHANICAL SOUNDING DEVICE FOR USE WITH ACOUSTIC TELEMETRY SYSTEM

(71) Applicant: Weatherford Technology Holdings, LLC, Houston, TX (US)

(72) Inventors: Brandon C. Goodman, Houston, TX (US); Joshua V. Symms, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/598,316

(22) Filed: Mar. 7, 2024

(65) Prior Publication Data

US 2025/0283407 A1 Sep. 11, 2025

Related U.S. Application Data

(60) Provisional application No. 63/562,353, filed on Mar. 7, 2024.

(51) Int. Cl.

| | |
|---|---|
| ***E21B 47/14*** | (2006.01) |
| ***E21B 47/16*** | (2006.01) |
| ***E21B 47/18*** | (2012.01) |

(52) U.S. Cl.

CPC ..... *E21B 47/18* (2013.01); *E21B 47/14* (2013.01); *E21B 47/16* (2013.01)

(58) Field of Classification Search

None

See application file for complete search history.

(56) References Cited

U.S. PATENT DOCUMENTS

| | | | |
|---|---|---|---|
| 4,298,970 | A | 11/1981 | Neil et al. |
| 4,314,365 | A | 2/1982 | Petersen et al. |

(Continued)

FOREIGN PATENT DOCUMENTS

| | | | |
|---|---|---|---|
| CN | 112096346 | B | 10/2022 |
| CN | 112112602 | B | 3/2023 |
| EP | 3464791 | A1 | 4/2019 |

OTHER PUBLICATIONS

Baker Hughes, "Xact bi-directional acoustic telemetry service," Brochure, copyright 2021.

(Continued)

*Primary Examiner* — Curtis A Kuntz
*Assistant Examiner* — Jerold B Murphy
(74) *Attorney, Agent, or Firm* — Cabello Hall Zinda, PLLC

(57) ABSTRACT

An acoustic telemetry system used with a wellbore assembly in a wellbore includes a hydro-mechanical sounding devices, relays, and a receiver. The sounding device includes a housing defining a chamber with an inlet port and at least one outlet port. A piston disposed in the chamber is movable against a strike face in the chamber in response to a hydraulic pressure differential. The impact of the piston against the strike face can produce an acoustic vibration, which can have defined characteristics. One or more relays disposed on the tubing electronically generate an acoustic signal in response to the acoustic vibration produced by the device. The acoustic signal can then be telemetered to a receiver at surface to determine a positive indication of an operation downhole.

25 Claims, 7 Drawing Sheets

(56) References Cited

U.S. PATENT DOCUMENTS

| | | | | |
|---|---|---|---|---|
| 6,907,927 | B2 * | 6/2005 | Zheng | E21B 31/005 166/177.6 |
| 7,909,094 | B2 | 3/2011 | Schultz et al. | |
| 7,990,282 | B2 | 8/2011 | Huang et al. | |
| 8,463,548 | B2 | 6/2013 | Gies | |
| 8,485,277 | B2 | 7/2013 | Hulden et al. | |
| 8,863,837 | B2 | 10/2014 | Bender et al. | |
| 8,902,078 | B2 | 12/2014 | Vick, Jr. et al. | |
| 9,631,485 | B2 * | 4/2017 | Keller | E21B 17/1078 |
| 9,759,062 | B2 | 9/2017 | Deffenbaugh et al. | |
| 9,951,606 | B2 | 4/2018 | Ariaratnam et al. | |
| 10,060,251 | B2 | 8/2018 | Stokely et al. | |
| 10,612,366 | B2 | 4/2020 | Gilleland et al. | |
| 2011/0122727 | A1 | 5/2011 | Gleitman et al. | |
| 2014/0216727 | A1 | 8/2014 | Kasyanov et al. | |
| 2015/0114716 | A1 * | 4/2015 | Yang | E21B 28/00 166/332.1 |
| 2021/0215038 | A1 | 7/2021 | Schaeffer et al. | |
| 2023/0112854 | A1 | 4/2023 | Garcia et al. | |
| 2025/0092775 | A1 * | 3/2025 | Weirich | E21B 47/00 |

OTHER PUBLICATIONS

Halliburton, "DynaLink® Telemetry System," Brochure, dated Dec. 2021.

Int'l Search Report and Written Opinion in PCT/US2025/010872 dated Apr. 23, 2025, 10-pgs.

* cited by examiner

HYDRO-MECHANICAL SOUNDING DEVICE FOR USE WITH ACOUSTIC TELEMETRY SYSTEM

CROSS-REFERENCE TO RELATED APPLICATIONS

This application claims the benefit of U.S. Provisional Appl. No. 63/562,353, filed Mar. 7, 2024, which is incorporated herein by reference in its entirety.

BACKGROUND OF THE DISCLOSURE

Various types of data telemetry systems are used in wellbores. For example, mud pulse, wired drillpipe (WDP), or electromagnetic (EM) systems can be used. Many of these systems require complicated installation and high costs. For instance, current forms of acoustic telemetry require expensive electro-mechanical sounding technologies that use downhole batteries and electronics to create, communicate, and relay acoustic signals between various smart tools within a well completion.

For example, an electro-mechanical apparatus can be added to a tool to enable the tool to be used within an acoustic telemetry system. These "smart tools" can be actuated by these signals, or they can be actuated using typical hydraulic or mechanical means. Once actuated, these "smart tools" using the electro-mechanical apparatus can relay signals back to the surface operator to indicate that the smart tool has been functioned. It may be advantageous for very complex tools (e.g., downhole multi-function valves) that perform complex functions to have this level of technology and cost associated with them. However, many operations for downhole tool may be simpler in nature so adding complex electro-mechanical functions to such tools (e.g., packers and sleeves) can make an inexpensive tool cost prohibitive. With that said, many operators desire positive surface indications that these simpler downhole tools have functioned and completed their tasks.

The subject matter of the present disclosure is directed to overcoming, or at least reducing the effects of, one or more of the problems set forth above.

SUMMARY OF THE DISCLOSURE

A hydro-mechanical sounding device disclosed herein is used with a wellbore assembly in a wellbore. The hydro-mechanical sounding device comprises a housing and a piston. The housing defines a chamber therein. The housing defines at least one inlet port communicating the chamber with the wellbore assembly, and the housing further defines at least one outlet port communicating the chamber with the wellbore. The chamber has a striking surface toward the at least one outlet port. The piston is disposed in the chamber and has first and second faces. The first face is exposed toward the at least one inlet port of the chamber, and the second face is exposed toward the at least one outlet port of the chamber. The piston is movable from a first position proximate the at least one inlet port toward a second position against the striking surface in response to a hydraulic pressure differential between the first and second faces. The second face of the piston is configured to strike the striking surface and is configured to produce an acoustic vibration in response thereto.

An acoustic telemetry system disclosed herein is used with a wellbore assembly in a wellbore. The acoustic telemetry system comprises at least one sounding device, at least one relay, and a receiver. The at least one sounding device is disposed in the wellbore. The at least one sounding device comprises a piston and a striking surface disposed in a chamber. The piston is movable toward the striking surface in response to hydraulic pressure communicated from the wellbore assembly against the piston. In turn, the piston is configured to produce an acoustic vibration in response to striking against the striking surface. The at least one relay is disposed in the wellbore proximate the at least one sounding device. The at least one relay is configured to detect the acoustic vibration and is configured to electronically telemeter an acoustic signal in the wellbore in response to the detection of the acoustic vibration. The receiver is configured to receive the acoustic signal telemetered from the at least one relay.

Each sounding device can be associated with an associated downhole tool disposed on the wellbore assembly. The piston can be movable in response to the hydraulic pressure produced by an operation of the associated downhole tool.

In one configuration, each relay comprises processing circuitry configured to: detect one or more characteristics of the acoustic vibration; and electronically produce, based on the one or more characteristics detected, a predefined one of a plurality of acoustic signals as a predefined acoustic signal. Additionally, the receiver comprises processing circuitry configured to: detect the predefined acoustic signal; and determine an indication of an event downhole based on the detection.

In another configuration, each relay is configured to receive the acoustic vibration and electronically produce the acoustic signal reproducing one or more characteristics of the acoustic vibration. Additionally, the receiver comprises processing circuitry configured to: detect the one or more characteristics of the acoustic signal; and determine an indication of an event downhole based on the detection.

A method disclosed herein is used with a wellbore assembly in a wellbore. The method comprises: performing an operation downhole; moving, in response to hydraulic pressure from the operation, a piston in a chamber of a hydro-mechanical sounding device disposed in the wellbore; producing an acoustic vibration by moving the piston in the chamber and/or striking a strike face of the piston moved against a striking surface of the chamber; receiving the acoustic vibration at a relay disposed in the wellbore proximate the hydro-mechanical sounding device; electronically producing an acoustic signal at the relay in response to the acoustic vibration received; telemetering the acoustic signal to a receiver; and determining, based on the acoustic signal telemetered thereto, an indication of the operation at the receiver.

The foregoing summary is not intended to summarize each potential embodiment or every aspect of the present disclosure.

DETAILED DESCRIPTION OF THE DISCLOSURE

Figure 1:
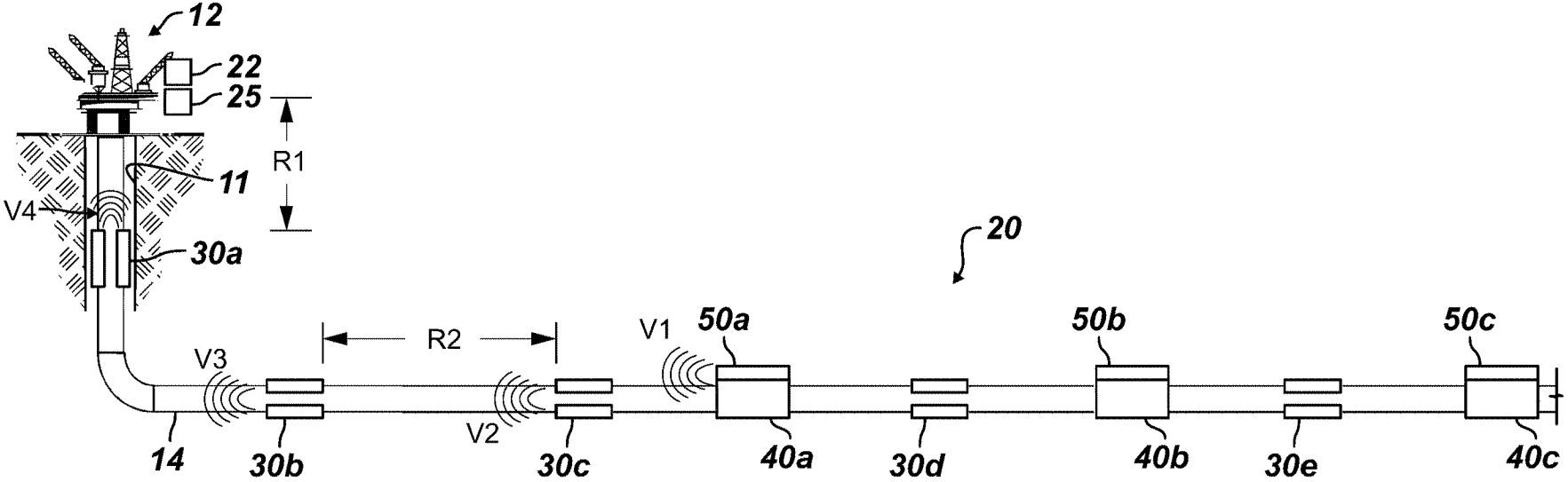
FIG. 1 illustrates a well completion having an acoustic telemetry system according to the present disclosure.

FIG. 1 illustrates a wellbore assembly 10 having an acoustic telemetry system 20 according to the present disclosure. The acoustic telemetry system 20 is used with tubing 14 in a wellbore 11 of the wellbore assembly 10. The acoustic telemetry system 20 includes a receiver 25, one or more relays or repeaters 30*a-e*, and one or more hydro-mechanical sounding devices 50*a-c*. In this example installation, five relays 30*a-e* and three hydro-mechanical sounding devices 50*a-c* are shown. Other installations can have different arrangements and number of elements.

The receiver 25, which can be at surface on a rig 12 or can be located elsewhere, has a receiver signal range (R1) and is configured to receive an acoustic input. The receiver 25 or other control unit 22 can then analyze the acoustic input to determine information according to the present disclosure, such as determining an indication of an operation performed downhole by a downhole tool.

The relays 30*a-e* are disposed on the tubing 14. Each relay 30*a-e* is configured to electronically produce an acoustic signal in response to an acoustic input received during use. To do this, each relay 30*a-e* may have a relay signal range (R2) to detect an acoustic input and to in turn telemeter the acoustic signal produced. As shown, each relay 30*a-e* is disposed on the tubing 14 within a relay signal range (R2) of at least one other of the relays 30*a-e* or within the receiver signal range (R1) of the receiver 25.

The acoustic telemetry devices 50*a-c* are hydro-mechanical sounding devices disposed on the tubing 14. When an operation is performed downhole, each of the hydro-mechanical sounding device 50*a-c* is configured to produce an acoustic vibration or signal in response to a change (e.g., increase) in hydraulic pressure in the tubing 14 from the performed operation. For example, a downhole tool 40*a-c* disposed on the tubing 14 proximate the hydro-mechanical sounding device 50*a-c* can be operated, which can generate the change in the hydraulic pressure to produce the acoustic vibration. Once generated, the acoustic vibration can travel through the walls of the tubing 14, through the fluid in the tubing 14, through the fluid in the wellbore annulus, or through a combination thereof.

The hydro-mechanical sounding device 50*a-c* can be implemented on or within a downhole tool 40*a-c*, such as a packer, a sleeve, a stage tool, or the like, to signal the occurrence of a downhole event. Alternatively, the hydro-mechanical sounding device 50*a-c* can be implemented as a stand-alone device to signal the occurrence of a downhole event. In general, the hydro-mechanical sounding device 50*a-c* can be mounted on the downhole tool 40*a-c*, can be integrated into housing components of the downhole tool 40*a-c*, can be mounted on a welded pup joint mount on the tubing 14, or can be mounted on the tubing 14 using brackets. These and other configurations can be used to incorporate the hydro-mechanical sounding device 50*a-c* with the wellbore assembly.

The hydro-mechanical sounding device 50*a-c* can be "tuned" to create an acoustic vibration downhole with a predefined signature (e.g., a certain frequency, a decibel level, or the like) to signify a specific event in the operation of the well. To do this, the hydro-mechanical sounding device 50*a-c* does not require the use of complex, expensive downhole batteries, or electro-mechanical equipment. Advantageously, the hydro-mechanical sounding device 50*a-c* does not require temperature and pressure sensitive electronics so the hydro-mechanical sounding device 50*a-c* can provide improved reliability for some implementations.

As noted, the hydro-mechanical sounding device 50*a-c* can be "tuned" to create an acoustic vibration downhole having a predefined signature (e.g., a certain frequency, decibel level, or the like) to signify a specific event in the operation of the well. In conjunction with the actuation method (hydraulic or mechanical) of the downhole event and the timing of the downhole event, the hydro-mechanical sounding device 50*a-c* can create an acoustic vibration within the wellbore that can be observed by the other acoustic telemetry relays 30*a-e* within the well. In turn, these relays 30*a-e* can provide strong positive feedback to an operator at surface that the event has occurred.

For example, if the specific event in the operation of the well is the functioning of a downhole tool 40*a-c*, the hydro-mechanical sounding device 50*a-c* can create an acoustic vibration within the wellbore 11 to indicate that the downhole tool 40*a-c* has functioned as intended. If, for example, there a multiple sliding sleeves 40*a-c* within the wellbore assembly 10, a different "frequency" can be created or "tuned" independently for the operation of each sliding sleeve 40*a-c*.

As shown the example of FIG. 1, operation of the downhole tool 40*a* can actuate the hydro-mechanical sounding device 50*a* associated with the downhole tool 40*a* to produce an acoustic vibration (V1). The relay 30*c* within a relay signal range (R2) of the hydro-mechanical sounding device 50*a* detects the acoustic vibration (V1) as acoustic input for the relay 30*c*. The relay 30*c* electronically produces an acoustic signal (V2) in response to the acoustic input from the sounding device 50*a*. The relay 30*c* has a relay signal range (R2) to telemeter the acoustic signal (V2) produced to another relay 30*b*, which electronically produces an acoustic signal (V3) in response to the acoustic input from the relay 30*c*. This relaying continues to telemeter a final acoustic signal (V4) to the receiver 25 for analysis.

As noted above, an acoustic signal can be relayed to surface to provide strong positive feedback to an operator at surface that a downhole event has occurred (e.g., a downhole tool 40*a-c* has functioned as intended). Each acoustic signal can indicate which event has occurred (e.g., which downhole tool 40*a-c* has functioned). Again, if there a multiple sliding sleeves 40*a-c* within the wellbore assembly 10, a different "frequency" can be created or "tuned" independently for the operation of each sliding sleeve 40*a-c*.

Figure 2:
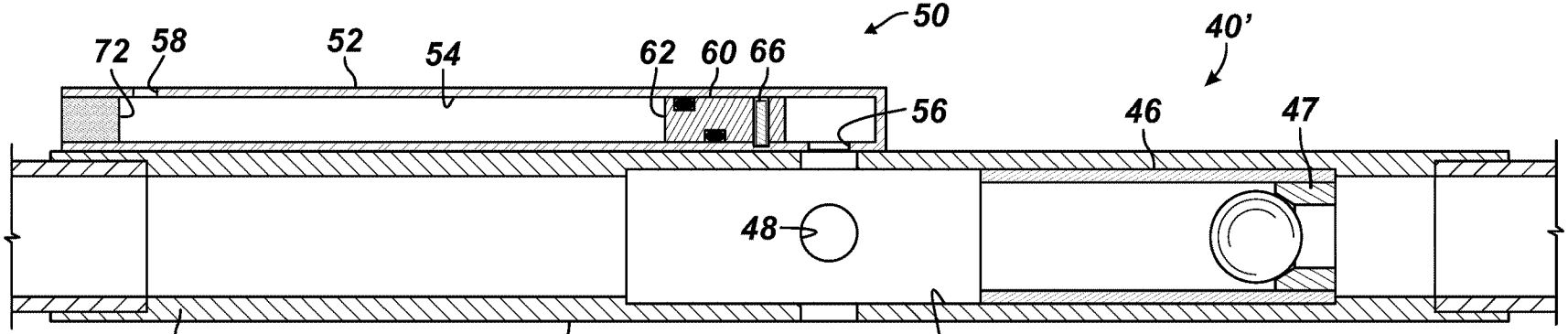
FIG. 2 illustrates a cross-sectional view of an example of a hydro-mechanical sounding device associated with a downhole tool.

FIG. 2 illustrates a cross-sectional view of an example of a hydro-mechanical sounding device 50 associated with a downhole tool, which is a sliding sleeve 40' in this example. As shown, the sliding sleeve 40' includes a housing 42 disposed on tubing 14. An insert 46 is movable in the bore 44 of the housing 42. For example, a plug or ball deployed to the sliding sleeve 40' can land on a seat 47 of the insert 46, and tubing pressure applied behind the seated ball can move the insert 46 in the bore 44. Movement of the insert 46 can open the ports 48 in the housing 42 to communicate fluid to the wellbore annulus (not shown) outside the sliding sleeve 40'.

The hydro-mechanical sounding device 50 can be attached to, incorporated into, or otherwise associated with the sliding sleeve 40'. Briefly, the sounding device 50 includes a housing 52 having a chamber 54, an inlet port 56, and an outlet port 58. A piston 60 is movably disposed in the chamber 54. The chamber 54 can be filled with wellbore fluid with the outlet port 58 open to the wellbore annulus. Alternatively, chamber 54 can be filled with a predefined fluid with the outlet port 58 plugged with a temporary seal. Hydraulic pressure is communicated through the inlet port 56 to the chamber 54 (e.g., hydraulic pressure from one of the sliding sleeve's ports 48 can communicate with the device's inlet port 56). The build-up of hydraulic pressure behind the piston 60 can shear it free so that the piston 60 moves in the chamber 54 toward the striking surface 72. As the piston 60 moves, the fluid in the chamber 54 is expelled to the wellbore through the outlet port 58. Eventually, the piston's strike face 62 strikes a striking surface 72 of a strike plate 70 of the sounding device 50 with a strike force. The strike produces an acoustic vibration in the wellbore and/or the tubing 14, which can then be detected as an acoustic input to a relay (30: FIG. 1) within range. The expelled fluid from the outlet port 58 can also produce an acoustic vibration depending on the implementation.

Figure 3A:
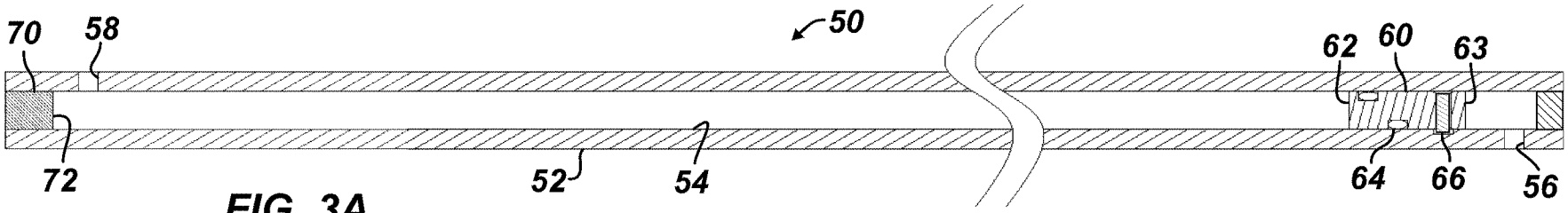
FIG. 3A illustrates a cross-sectional view of a hydro-mechanical sounding device of the present disclosure in an unactuated state.
Figure 3B:
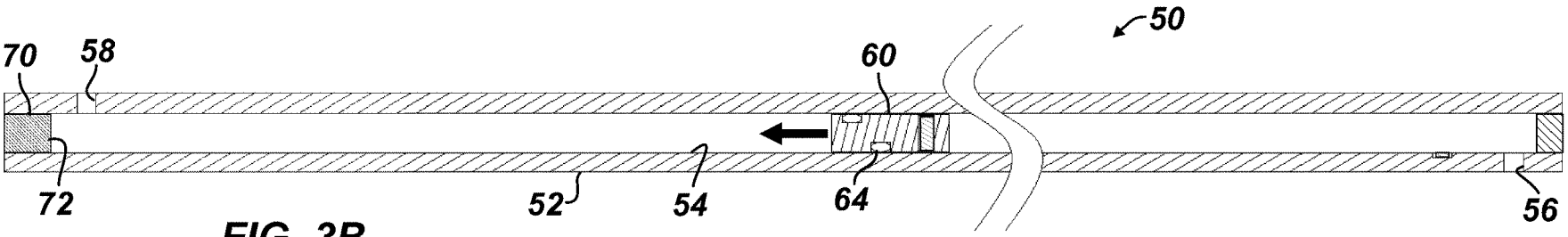
FIG. 3B illustrates a cross-sectional view of the hydro-mechanical sounding device of the present disclosure after actuation.
Figure 3C:
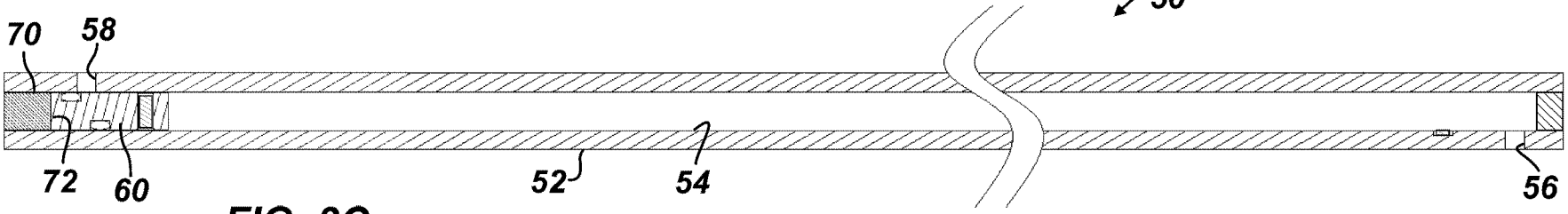
FIG. 3C illustrates a cross-sectional view of the hydro-mechanical sounding device of the present disclosure producing an acoustic signal.

Looking at the hydro-mechanical sounding device 50 in more detail, FIGS. 3A-3C illustrates cross-sectional views of the disclosed sounding device 50 during operation. The hydro-mechanical sounding device 50 is shown in an unactuated state. As noted briefly above, the hydro-mechanical sounding device 50 includes a housing 52 and a piston 60. The housing 52 defines a chamber 54 therein, and the housing 52 defines an inlet port 56 communicating the chamber 54 with tubing (e.g., a tubing bore, a tubing annulus, or a tool bore). The housing 52 also defines at least one outlet port 58 communicating the chamber 54 with the wellbore (e.g., wellbore annulus). The chamber 54 has a striking surface 72 toward the outlet port 58. For assembly purposes, for example, a strike plate 70 or other component affixed to the housing 52 can include the striking surface 72 exposed to the chamber 54.

The piston 60 is disposed in the chamber 54 and has first and second faces 62, 63. The first or piston face 63 is exposed toward the inlet port 56 of the chamber 54, and the second or strike face 62 is exposed toward the outlet port 58 and the striking surface 72 of the chamber 54.

As shown, a retainer or shear mechanism 66 temporarily retains the piston 60 in the unactuated position of FIG. 2. The retainer 66, which can be a shear pin, shear collar, or comparable element, is configured to release the piston 60 to move toward the strike position in response to a predetermined threshold of the hydraulic pressure differential in the chamber 54 acting on the piston 60. As also shown, the piston 60 can have seals 64 that seal the piston 60 in the chamber 54. When the pressure at the inlet port 56 is increased above the requisite shear value, the piston 60 is free to travel toward the strike plate 70. When the strike plate 70 is struck, an acoustic vibration or sound is made that can then be picked up by the acoustic telemetry relays 30*a-e* within the wellbore 11.

The piston 60 is movable from a first position (FIG. 3A) proximate the inlet port 56 toward a second position (FIG. 3C) against the striking surface 72 in response to a hydraulic pressure differential between the piston's faces 62, 63. As shown in FIG. 3C, the strike face 62 of the piston 60 is configured to strike the striking surface 72, which produce an acoustic vibration.

One or more variables of at least one of the chamber 54, the outlet port 58, the striking surface 72, the piston 60, the strike face 62, and the hydraulic pressure differential can be configured to tune one or more characteristics of the acoustic vibration produced by the hydro-mechanical sounding device 50. In general, the one or more characteristics of the acoustic vibration can be selected from the group consisting of amplitude, frequency, pitch, tone, etc.

Figure 4:
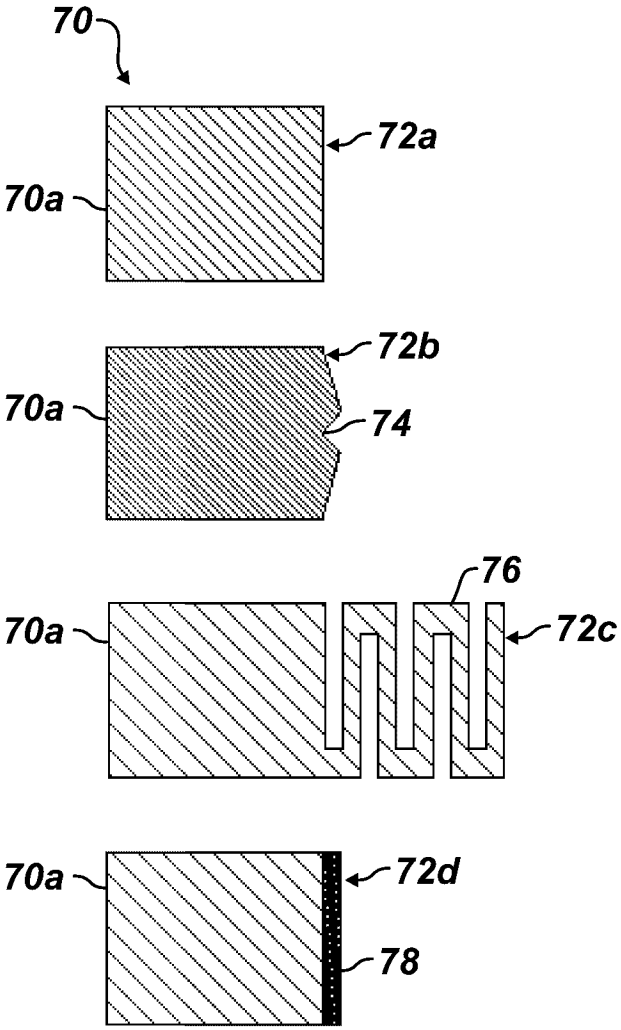
FIG. 4 illustrates cross-sectional views of example strike plates for the hydro-mechanical sounding device of the present disclosure.

One or more variables of at least one the striking surface 72, chamber (54) surfaces, and the piston's strike face 62 can be configured to tune one or more characteristics of the acoustic vibration. For example, FIG. 4 illustrates cross-sectional views of example strike plates 70*a-d* for the hydro-mechanical sounding device (50) of the present disclosure. Moreover, FIG. 5 illustrates cross-sectional views of example pistons 60*a-c* for the hydro-mechanical sounding device (50) of the present disclosure.

In general, the strike plates 70*a-d* and the pistons 60*a-c* can be comprised of different materials. The materials can be the same or different from one another. The various materials for the strike plates 70*a-d* and pistons 60*a-c* can be used in various combinations to produce different acoustic characteristics.

Additionally, as shown in FIG. 4, features of the striking surfaces 72*a-d* can be configured to produce acoustic characteristics. Strike plate 70*a* has a striking surface 72*a* that is a flat surface. The striking surface 72*b* on strike plate 70*b* has a contoured surface 74. The striking surface 72*c* on strike plate 70*c* has a collapsible surface 76. Finally, the striking surface 72*d* on strike plate 70*d* has a coated surface 78, such as being coated with elastomer. One or more of these features can be combined with one another. These and other variations can be possible for the striking surfaces 72*a-d*.

Figure 5:
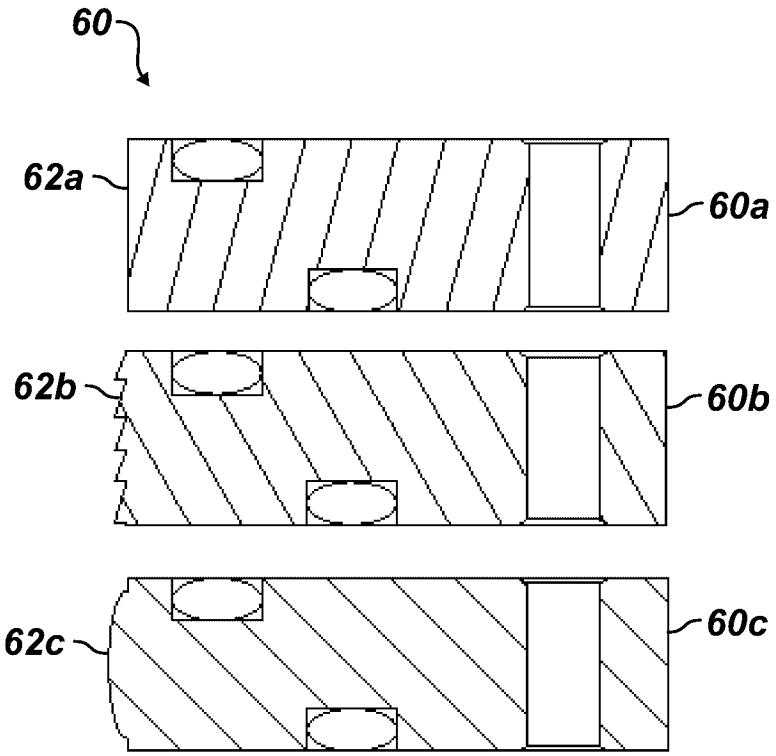
FIG. 5 illustrates cross-sectional views of example pistons for the hydro-mechanical sounding device of the present disclosure.

As shown in FIG. 5, features of the piston's strike faces 62*a-c* can be configured to produce acoustic characteristics. For example, the piston's strike face 62*a* on the piston 60*a* can have a flat surface. The piston's strike face 62*b* on the piston 60*c* can have a ridged surface, or the piston's strike face 62*c* on the piston 60*c* can have a contoured surface. These and other variations can be possible for the piston's strike face 62. Additionally, any of the features of the strike faces 62*a-c* used on the pistons 60*a-c* can be used on the strike surfaces of the strike plate 70 and vis-a-versa. Overall, the examples of the strike faces 62*a-c* and striking surfaces 72*a-d* shown above can be interchanged and combined in different variations with one another to produce various characteristics. These and other alterations can be used for the strike faces 62*a-c* and striking surfaces 72*a-d*.

Figures 6A, 6B, 6C:
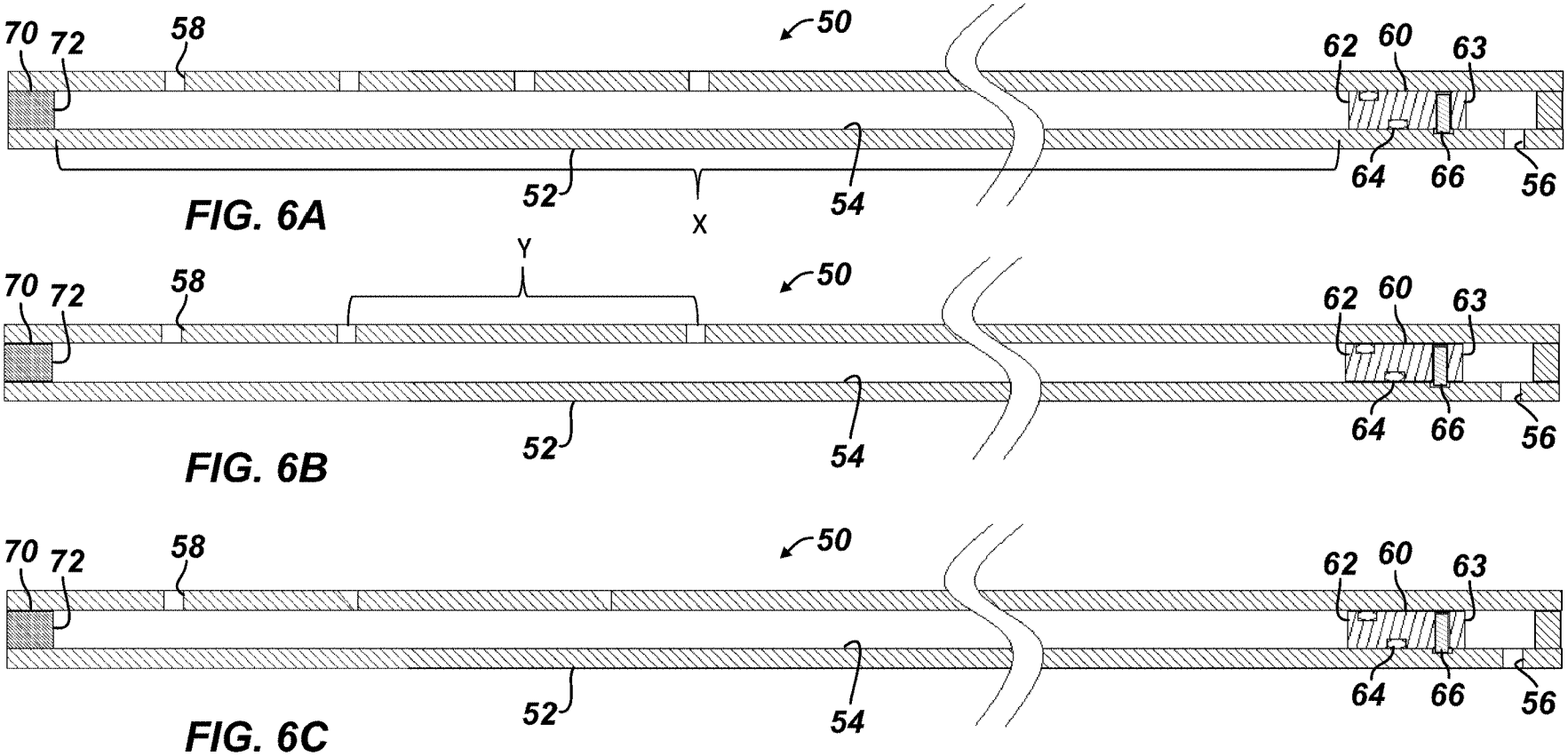
FIG. 6A illustrates a cross-sectional view of another hydro-mechanical sounding device of the present disclosure in an unactuated state.
FIG. 6B illustrates a cross-sectional view of yet another hydro-mechanical sounding device of the present disclosure in an unactuated state.
FIG. 6C illustrates a cross-sectional view of an additional hydro-mechanical sounding device of the present disclosure in an unactuated state.

In addition to or in the alternative to strike and piston variables, one or more variables of the outlet port 58 of hydro-mechanical sounding device 50 can configured to tune the one or more characteristics of the acoustic vibration. For example, FIGS. 6A-6C illustrate cross-sectional views of other hydro-mechanical sounding devices 50 of the present disclosure. Examples of altered port size and positions are shown. The various geometries are interchangeable between the outlet ports 58.

As shown in FIG. 6A, an overall distance (X) of the piston 60 from the strike plate 70 can be configured to produce acoustic characteristics. As also shown in FIG. 6A, the housing 52 can define a plurality of the outlet ports 58 disposed along a length of the chamber 54. The one or more variables of the outlet ports 58 are configured to tune the one or more characteristics of the acoustic vibration. For example, spacing between the outlet ports 58 can be configured to tune the acoustic characteristics. As shown in FIG. 6A, even spacing of the outlet ports 58 from one another along the length can be used. As shown in FIG. 6B, varied spacing (Y) of the outlet ports 58 from one another along the length can be used. The different sizing and spacings can alter the duration, pulsing, and cadence of multiple sounds or notes in the acoustic vibration produced.

Size and/or shape of the outlet ports 58 can also be used to produce the acoustic characteristics. For example, equal sizing or different sizing of the outlet ports 58 can be used. Also, equal shaping or different shaping of the outlet ports 58 compared to one another can be used. For example, FIG. 6C shows examples of alternative output ports 59 that operate as "whistles," allowing expelled fluid passed through these outlet ports 59 to rapidly expand and oscillate as the fluid exits the outlet ports 59. Various geometries can be used for these alternative outlet ports 59. To create and modulate the acoustic vibrations produced hydro-mechanically, the sounding device 50 can use other features as disclosed herein. For example, the sounding device 50 can use a shear mechanism 66 (i.e., shear pins 66) having a predetermined threshold to retain the piston 60, which is pinned and sized to strike the striking surface 72, thus producing a sound. The piston 60 sheared free can move fluid within the volume of the chamber 54. The moving fluid can provide a primary, secondary, or tertiary sound picked up by an acoustic telemetry relay. The chamber 54 can be ported such that the piston's movement is modulated, thus changing the manner or strike force with which the piston 60 strikes the striking surface 72 and subsequently defining the "tune" or frequency of the sound produced. The mating striking face 62 and striking surface 72 that contact one another may have interacting geometries to further modulate the frequency of the acoustic vibration produced. The outlet ports 58 may also be cut in such a way that a downhole "whistle" is created, further providing sound modulation to the sounding device 50.

Previous examples include a strike plate 70 that may be a permanently fixed surface to be impacted by a single piston 60 traveling in the chamber 54. In other configurations of the disclosed sounding device, multiple pistons 60 can be used in parallel to one another in different chamber portions or in opposite directions within the same chamber. Also, multiple pistons 60 can be used in series, being arranged inline within the same chamber 54. These configuration can induce multiple acoustic signals and sequential or consecutive shear events within the tool. For instance, multiple "pings" or other acoustic signals can be generated from the same device.

Figure 7A:
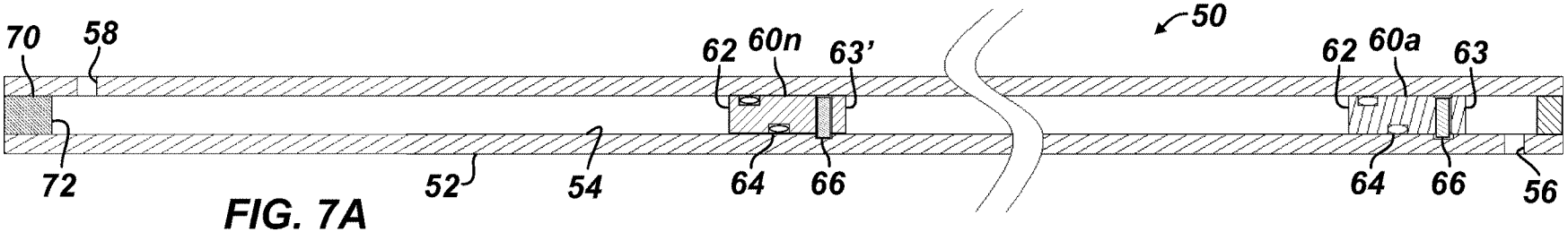
FIG. 7A illustrates a cross-sectional view of a hydro-mechanical sounding device 50 of the present disclosure having consecutively freed pistons.

Turning then to FIG. 7A, a cross-sectional view of another hydro-mechanical sounding device 50 of the present disclosure shows multiple pistons 60*a-n* arranged as a series in the chamber 54. For this device 50 in FIG. 7A, several consecutive strike faces are provided within the chamber 54 using the plurality of pinned pistons 60*a-n*.

During operations, an initial piston 60*a* can be sheared free to move in the chamber 54, and its strike face 62 can then engage a back face 63' of a subsequent piston 60*n* pinned in the chamber 54. This initial impact can produce an initial acoustic signal. Pressure can eventually shear the subsequent piston 60*n* free so that the pistons 60*a-n* move in tandem along the chamber 54. The tandem pistons 60*a-n* can engage additional pistons (not shown) disposed in the chamber 54 to produce additional acoustic signals. Eventually, a final one of the pistons 60*n* can eventually impact a striking surface 72 of a strike plate 70 to produce a final acoustic signal. The consecutive impacts of the freed pistons 60*a-n* leading further into the chamber 54 can provide additional forms of variation to the acoustic signals disclosed herein. Several variations can be used for the piston's faces, shear values, separations between pistons 60*a-n*, etc.

In a further configuration based on multiple outlet ports disposed along the chamber 54 as in FIGS. 6A-6C, the arrangement shown here in FIG. 7A having multiple pistons 60*a-n* may also have multiple outlet ports disposed along the chamber 54. These outlet ports can be used to produce consecutive acoustic signals using the consecutively freed pistons 60*a-n*.

Figure 7B:
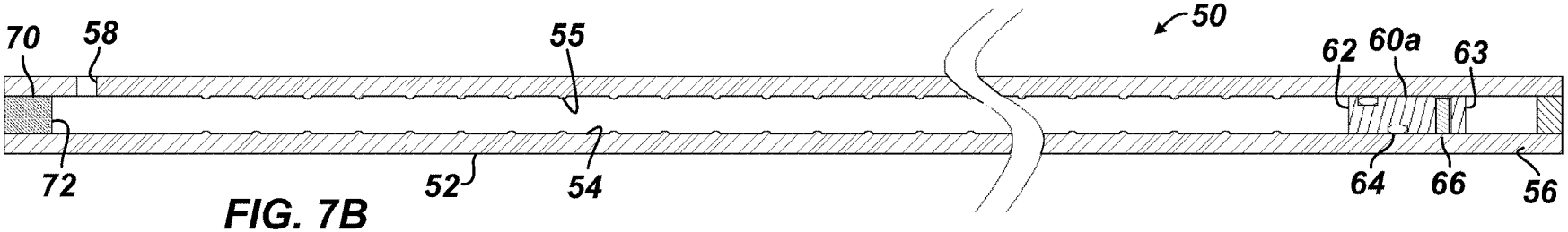
FIG. 7B illustrates a cross-sectional view of another hydro-mechanical sounding device 50 of the present disclosure having a modified surface in a chamber.

FIG. 7B illustrate a cross-sectional view of yet another hydro-mechanical sounding device 50 of the present disclosure. Previous examples have included chambers 54 that may have a uniform surface. For this device 50 in FIG. 7B, the chamber 54 includes surface modifications 55 along the surface of the chamber 54. These surface modifications 55 can include bumps, ridges, wickers, or other like profiles to modify the sound the piston 60 produces as it travels through the chamber 54. In this way, the surfaces modifications 55 can be configured to tune the one or more characteristics of the acoustic vibration.

In previous examples, it may have been inferred that a given downhole tool (40) may have one sounding device 50 associated with the tool (40). This is not strictly necessary. A set of tools (40) can be associated with a shared sounding device 50, or multiple sounding devices 50 can be associated with a given tool (40).

Figure 7C:
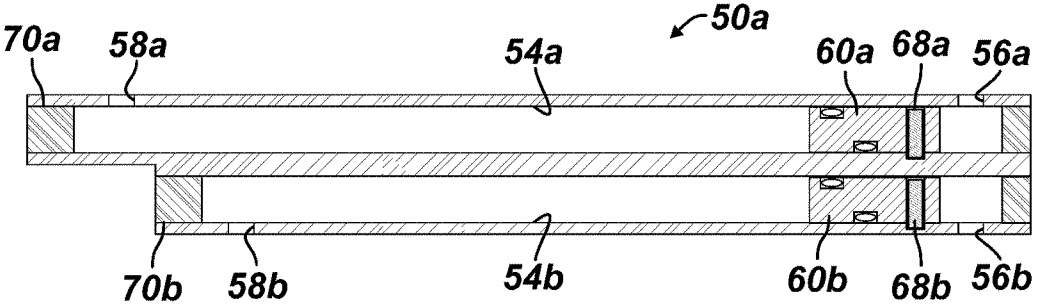
FIG. 7C illustrates a cross-sectional view of a combination hydro-mechanical sounding device 50 of the present disclosure.

FIG. 7C illustrates a combination sounding device 50*a* having a chamber with multiple chamber portions 54*a-b* and having multiple pistons 60*a-b*. Two chamber portions 54*a-b* are shown, but more could be provided. Each chamber portion 54*a-b* has its own piston 60-*b*, but each can have more than one piston 60*a-b*.

Each chamber portion 54*a-b* can have its own inlet 56*a-b*, which can communicate separately with the associated tool (40), although the inlets 56*a-b* can be shared. Each chamber portion 54*a-b* can have a different characteristic (e.g., diameter, length, size of outlet 58*a-b*, number of outlets 58*a-b*, etc.), and each piston 60*a-b* can have a different characteristic (e.g., diameter, strike face, shear value, etc.). During operations, the combination sounding device 50*a* can produce consecutive acoustic signals using the pistons 60*a-b* if consecutively freed by predetermined thresholds of their retainers 68*a-b*. For example, freeing one of the piston 60*a* may be associated with a first operation of the associated tool (40), while freeing the other piston 60*b* may be associated with a second operation of the associated tool (40). These and other variations are possible.

Figure 7D:
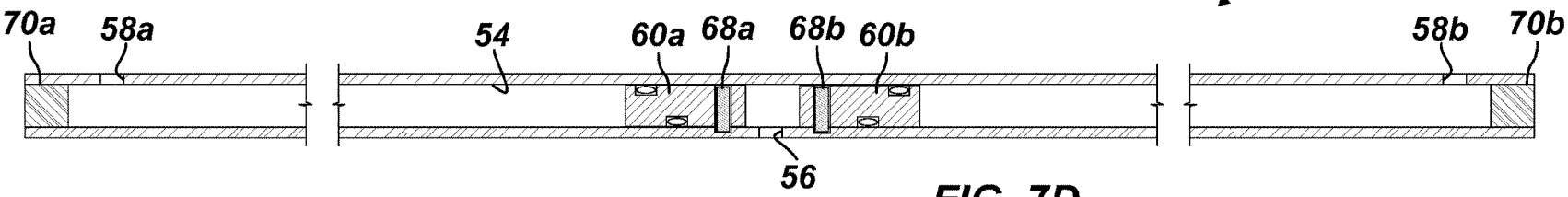
FIG. 7D illustrates a cross-sectional view of another combination hydro-mechanical sounding device 50 of the present disclosure.

FIG. 7D illustrates another combination sounding device 50*b* having multiple pistons 60*a-b* in a shared chamber 54. Each piston 60*a-b* shares an inlet port 56, which can communicate with the associated tool (40). Each side or portion of the chamber 54 can have a different characteristic (e.g., length, size of outlet 58*a-b*, number of outlets 58*a-b*, etc.), and each piston 60*a-b* can have a different characteristic (e.g., diameter, strike face, shear value, etc.). During operations, the combination sounding device 50*b* can produce a combined acoustic signal using the pistons 60*a-b* associated with an operation of the associated tool (40). Alternatively, the combination sounding device 50*b* can produce consecutive acoustic signals using the pistons 60*a-b* if consecutively freed. For example, freeing one of the piston 60*a* based on the shear value of the retainer 68*a* may be associated with a first operation of the associated tool (40), while freeing the other piston 60*b* based on the shear value of the retainer 68*b* may be associated with a second operation of the associated tool (40). These and other variations are possible.

Returning to FIG. 1, each tool 40*a-c* or set of similar tools 40*a-c* can be associated with a hydro-mechanical sounding device 50, which can be "tuned" by one or more of the aforementioned arrangements. The sounding device 50 can therefore produce a characteristic sound to be measured by acoustic telemetry relays 30*a-e* within the wellbore assembly 10. Once the sound is picked up by these relays 30*a-e*, the "message" associated with the produced acoustic signal can then be relayed to surface. At surface, the operator or software program can then decode this signal as a positive indication that a subsurface event associated with that frequency has occurred.

In the acoustic telemetry system 20, the acoustic telemetry relays 30*a-e* can be positioned at maximum extents of their signal range within the wellbore 11. The downhole tools 40*a-c* within the tubing 14 can each be equipped with a hydro-mechanical sounding device 50 that makes an acoustic vibration or noise that can be picked up and recognized by these relays 30*a-e*. The acoustic input(s) from the relay(s) 30*a-d* is then processed and relayed as acoustic signal(s) up the well to the operator at the surface.

Depending on a number of factors, the acoustic vibration or sound can be tuned by configuring one or a combination of the frequency, pitch, amplitude, decibel level, tone, etc. of the produced sound for a specific tool or shear event. Thus, each tool 40*a-c* within the wellbore 11, or a standalone sounding device 50, can have its own signature sound for its actuation.

As noted above, several factors or inputs that may be configured or altered to affect the sound made by the sounding device 50. For example, the distance (X) between the piston 60 and strike plate 70; the shear value of the shear mechanism 66; the shape and size of the inlet port 56; the shape, size, number, and spacing of the outlet port(s) 58; the number of pistons 60 (and their associated variables); and the number of chamber portions (and their associated) can be configured. In additional examples, the density of the fluid within the volume chamber 54 and the density of the fluid displacing the fluid within the volume chamber 54 can be configured. The surface finishes, surface coatings, contours, and the like on the strike face 62 and/or striking surface 72 can be configured. Surface finishes and coatings on the walls of the chamber 54 can be configured. Profiles, such as wickers, ridges, bumps, etc. can be configured on the surface of the chamber. The materials utilized for the piston 60, strike plate 70, and housing 52 can be configured. Additionally, the "sound(s)" created by the sounding device 50 can be produced by both the sounds made as the piston passes each outlet port 58 and the sound made once the strike plate 70 is hit.

In one configuration, each of the relays 30*a-e* comprises processing circuitry that detects the acoustic vibration. Given that the relay 30*a-e* is located or associated with a particular sounding device 50 or downhole tool 40 so the location or proximity of the acoustic vibration offers a discernible characteristic. The detection by the sounding device 50 already provides an indication of the associated event or operation that has occurred downhole. The relay's processing circuitry can electronically produce an acoustic signals, which can be indicative of the associated event, operation, location, source, or the like being monitored. In turn, processing circuitry of the receiver 25 or control unit 22 can detect the acoustic signal and determine the indication of the associated operation, location, source, or the like.

In another configuration, each of the relays 30*a-e* comprises processing circuitry that detects one or more characteristics (e.g., frequency, amplitude, etc.) of the acoustic vibration. Based on the one or more characteristics detected, the processing circuitry can electronically produce a predefined one of a plurality of acoustic signals, which is indicative of the associated event or operation being monitored. In turn, processing circuitry of the receiver 25 or control unit 22 detects the predefined acoustic signal and determines an indication of the associated event or operation based on the detection.

In yet another configuration, each of the relays 30*a-e* can receive the acoustic vibration produced by the sounding device 50. Processing circuitry of the relay 30*a-e* can electronically generate an acoustic signal reproducing one or more characteristics of the original acoustic vibration. In turn, processing circuitry of the receiver 25 or control unit 22 can detect the one or more characteristics of the acoustic signal received. Using the detected characteristics, the processing circuitry can then determine an indication of the event.

Figure 8:
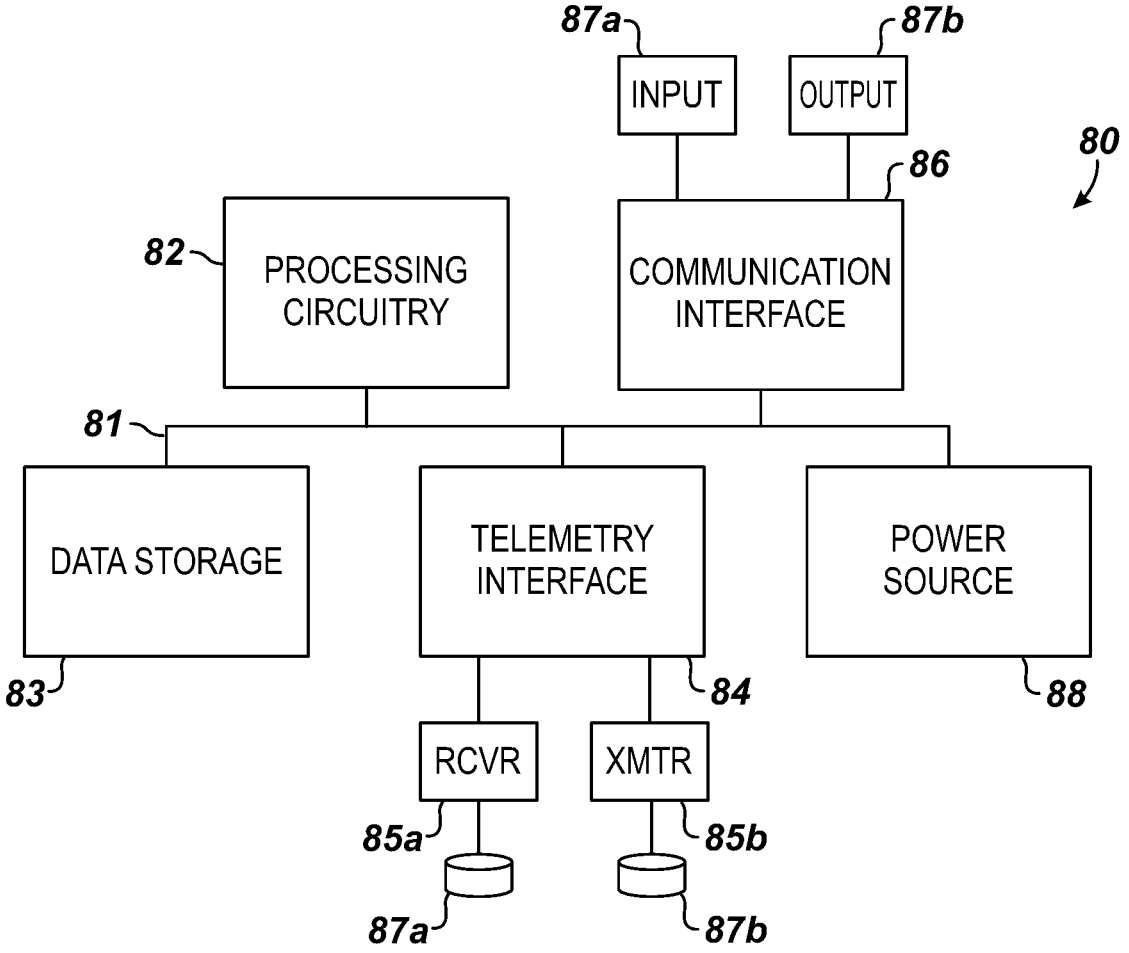
FIG. 8 illustrates a schematic view of an acoustic apparatus that can be used for a relay or a receiver of the disclosed acoustic telemetry system.

FIG. 8 illustrates a schematic view of an acoustic apparatus 80 for the acoustic telemetry system. The acoustic apparatus 80 can be used for the relay (30) and the receiver (25) of the acoustic telemetry system (20). The acoustic apparatus 80 includes a bus 81, a processing circuitry 82, a memory or data storage component 83, an acoustic telemetry unit 84, an input/output communication interface 86, and a power source or battery module 88.

The bus 81 includes a component that permits communication among the components of the acoustic apparatus 80. The processing circuitry 82 is implemented in hardware, firmware, or a combination of hardware and software. The processing circuitry 82 can be a microprocessor, a microcontroller, a digital signal processor (DSP), a field-programmable gate array (FPGA), an application-specific integrated circuit (ASIC), or another type of processing component. In some examples, the processing circuitry 82 can include one or more processors capable of being programmed to perform a function.

The data storage component 83 may include one or more memories, such as a random-access memory (RAM), a read only memory (ROM), and/or another type of dynamic or static storage device (e.g., a flash memory, a magnetic memory, and/or an optical memory) that stores information and/or instructions for use by the processing circuitry 82.

The input/output communication interface 86 includes a component that permits the acoustic apparatus 80 to send and receive signals and controls and to provide power to components. For example, the communication interface 86 may include an input component 87*a* that receives sensor measurements, operational feedback, and other input information from the components of the completion The communication interface 86 may also include an output component 87*b* that provides control signals, actuations, and other output information from the acoustic apparatus 80 to the components of completion.

The acoustic telemetry unit 84 includes a transceiver-like component (e.g., a transceiver and/or a separate receiver 85*a* and transmitter 85*b*), which has one or more sensors, transducers, or other acoustic elements 87*a-b*. The acoustic telemetry unit 84 enables the acoustic apparatus 80 to communicate acoustically with other equipment, such as with other relays, receivers, and the like. For example, the acoustic telemetry unit 84 permits the acoustic apparatus 80 to receive an acoustic signal from another relay (30) and from sounding devices 50 and to send an acoustic signal to another relay (30) or receiver (25).

The power source 88 is connected along the bus 81 to supply power to the processing circuitry 82 and other the internal components of the acoustic apparatus 80. As a battery module, the power source 88 permits the acoustic apparatus 80 to be a portable integrated device for conducting the remote operations as disclosed herein.

The acoustic apparatus 80 may perform one or more processes described herein. The acoustic apparatus 80 may perform these processes by the processing circuitry 82 executing software instructions stored by a non-transitory computer-readable medium, such as the data storage component 83. A computer-readable medium is defined herein as a non-transitory memory device. A memory device includes memory space within a single physical storage device or memory space spread across multiple physical storage devices.

Instructions may be read into the data storage component 83 from another computer-readable medium or from another device via the acoustic telemetry unit 84. When executed, instructions stored in the data storage component 83 may instruct the processing circuitry 82 to perform one or more processes described herein. Additionally, or alternatively, hardwired circuitry may be used in place of or in combination with instructions to perform one or more processes described herein. Thus, implementations described herein are not limited to any specific combination of hardware circuitry and software.

The number and arrangement of components shown in FIG. 8 are provided as an example. In practice, the acoustic apparatus 80 may include additional components, fewer components, different components, or differently arranged components than those shown in FIG. 8. Additionally, or alternatively, a set of components (e.g., one or more components) of the acoustic apparatus 80 may perform one or more functions described as being performed by another set of components of the acoustic apparatus 80.

Figure 9:
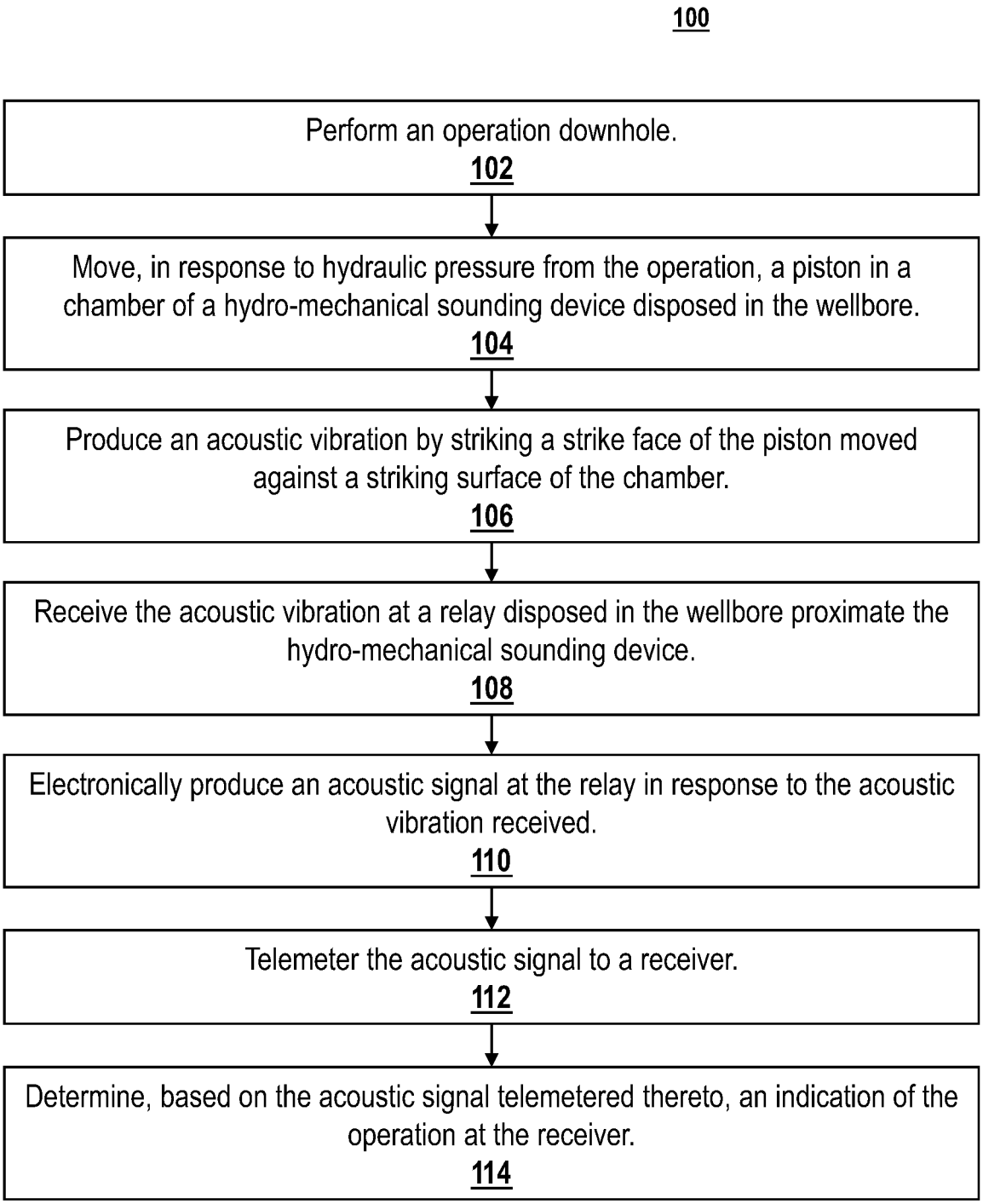
FIG. 9 illustrates a flow chart of a process according to the present disclosure.

FIG. 9 is a flowchart of a process 100, according to an example of the present disclosure. One or more process blocks of FIG. 9 may be performed by the acoustic telemetry system 20, and reference numerals for the system 20 shown above are used in the discussion that follows.

The process 100 involves performing an operation downhole (block 102). For example, a downhole tool (e.g., 40*a* in FIG. 1), such as a packer, a sleeve, a stage tool, or the like, disposed on the tubing 14 proximate the hydro-mechanical sounding device (e.g., 50*a*) can be operated, which can generate the change in the hydraulic pressure to produce the acoustic vibration. The produced hydraulic pressure from the operation enters the chamber 54 of the proximate sounding device 50*a* and moves the piston 60 in the chamber 54 of the sounding device 50*a* (block 104). As noted above, the piston 60 can be temporarily retained in place in the chamber 54 by a retainer or shear pin 66. In response to a predetermined threshold of the hydraulic pressure, the piston 60 is released, and the hydraulic pressure forces the piston 60 in the chamber 54 toward the striking surface 72. To better communicate the hydraulic pressure, the piston 60 can be sealed in the chamber 54 with seals 64.

An acoustic vibration is then produced by moving of the piston 60 in the chamber 54 and/or by striking a strike face 62 of the piston 60 against the striking surface 72 of the chamber 54 (block 106). In producing the acoustic vibration, one or more characteristics of the acoustic vibration produced by the hydro-mechanical sounding device 50*a* can be tuned by configuring one or more variables associated with at least one of: the chamber 54, an outlet port 58 of the chamber 54, the strike face 62, the piston 60, the striking surface 72, the striking plate 70, and the hydraulic pressure differential. In general and as noted above, the one or more configured variables can include values, parameters, or various details, such as: the length of the chamber 54; the diameter of the chamber 54; the thickness of the piston 60 and/or strike plate 70; the number of outlet ports 58' the material construction of the piston 60, strike plate 70, or the like; the strike force produced; surface design of the striking face 62 and/or striking surface 72; etc. depending on the feature of the sounding device 50 in question.

Configuring the characteristics of the acoustic vibration can include configuring one or more of amplitude, frequency, tone, duration, cadence, and proximity of the acoustic vibration produced. For example, tuning the one or more characteristics of the acoustic vibration produced by the hydro-mechanical sounding device 50*a* may include defining a plurality of outlet ports 58 disposed along a length of the chamber 54, and configuring, based on the outlet ports 58, a strike force of the strike face 62 against the striking surface 72. In another example, tuning the one or more characteristics of the acoustic vibration produced may include expelling fluid from an outlet port 58 of the chamber 54 in response to movement of the piston 60; and producing the acoustic vibration with the expelled fluid. In yet another example, tuning the one or more characteristics of the acoustic vibration produced may include configuring the strike face 62 and/or the striking surface 72, such as by configuring the contour, shape, or material construction of the striking face 62 and/or the striking surface 72.

Once generated, the acoustic vibration (e.g., V1) can travel through the walls of the tubing 14, through the fluid in the tubing 14, through the fluid in the wellbore annulus, or through a combination of these, until it reaches at least one proximate hydro-mechanical sounding device 50*a-c*. The acoustic vibration V1 is then received at a relay (e.g., 30*c*) disposed in the wellbore proximate the actuated hydro-mechanical sounding device 50*a* (block 108), and the relay 30*c* electronically produces an outgoing acoustic signal (e.g., V2) in response to the received acoustic vibration V1 (block 110). In one option, the relay 30 can act as a repeater in the sense that the relay 30 may reproduce the characteristics of the received acoustic vibration for transmission as the outgoing acoustic signal V2. In another option, the relay 30 may process the received acoustic vibration V1 for the characteristics and may determine underlying information from the processing (i.e., determine the operation, the downhole tool 40*a*, and/or other detail associated with the received acoustic vibration V1). In turn, the relay 30 may encode an indication of this underlaying information in the outgoing acoustic signal V2.

Eventually, the acoustic signal is telemetered to a receiver 25 (block 112). Depending on the location of the event downhole, several relays 30 may be needed to telemeter acoustic signals (e.g., V2, V3, V4) along the tubing string from the sounding device 50*a* to the receiver 25. In the end, the receiver 25 determines an indication of the operation based on the telemetered acoustic signal (block 114). Operations at surface can automatically determine information about the operation downhole, which can be used to perform some additional automatic operation or may provide operators with information useful for further operational control.

Although FIG. 8 shows example blocks of the process 100, the process 100 in some implementations may include additional blocks, fewer blocks, different blocks, or differently arranged blocks than those depicted in FIG. 8. Additionally, or alternatively, two or more of the blocks of the process 100 may be performed in parallel.

The acoustic telemetry system and methods disclosed here can be characterized by the following clauses:

Clause 1. A hydro-mechanical sounding device (50) used with a wellbore assembly (10) in a wellbore (11), the hydro-mechanical sounding device (50) comprising:

a housing (52) defining a chamber (54) therein, the housing (52) defining at least one inlet port (56) communicating the chamber (54) with the wellbore assembly (10), the housing (52) defining at least one outlet port (58) communicating the chamber (54) with the wellbore, the chamber (54) having a striking surface (72) toward the at least one outlet port (58); and a piston (60) disposed in the chamber (54) and having first and second faces (62, 63), the first face (63) exposed toward the at least one inlet port (56) of the chamber (54), the second face (62) exposed toward the at least one outlet port (58) of the chamber (54), the piston (60) being movable from a first position proximate the at least one inlet port (56) toward a second position against the striking surface (72) in response to a hydraulic pressure differential between the first and second faces, the second face of the piston (60) being configured to strike the striking surface (72) and configured to produce an acoustic vibration in response thereto.

Clause 2. The hydro-mechanical sounding device (50) of clause 1, comprising a retainer (66) temporarily retaining the piston (60) in the first position, the retainer (66) being configured to release the piston (60) to move toward the second position in response to a predetermined threshold of the hydraulic pressure differential.

Clause 3. The hydro-mechanical sounding device (50) of clause 1 or 2, wherein the piston (60) comprises seals sealing the piston (60) in the chamber (54).

Clause 4. The hydro-mechanical sounding device (50) of clause 1, 2 or 3, wherein one or more variables of at least one of the chamber (54), the outlet port (58), the strike face (62), the piston (60), the second face, and the hydraulic pressure differential are configured to tune one or more characteristics of the acoustic vibration.

Clause 5. The hydro-mechanical sounding device (50) of clause 4, wherein the one or more characteristics of the acoustic vibration are selected from the group consisting of amplitude, frequency, tone, duration, pulsing, cadence, and proximity.

Clause 6. The hydro-mechanical sounding device of clause 4, wherein the chamber defines one or more modifications disposed on a surface of the chamber, the one or more modifications being configured to tune the one or more characteristics of the acoustic vibration.

Clause 7. The hydro-mechanical sounding device (50) of clause 4, 5 or 6, wherein the housing (52) defines a plurality of the at least one outlet port (58) disposed along a length of the chamber (54), the one or more variables of the outlet ports (58) being configured to tune the one or more characteristics of the acoustic vibration.

Clause 8. The hydro-mechanical sounding device (50) of clause 7, wherein the one or more variables of the outlet ports (58) comprises spacing between the outlet port (58) ports, the spacing including even spacing of the outlet ports (58) from one another along the length or varied spacing of the outlet ports (58) from one another along the length.

Clause 9. The hydro-mechanical sounding device (50) of clause 7 or 8, wherein the one or more variable of the outlet ports (58) comprises a size or a shape of the outlet ports (58), the size including equal sizing of the outlet ports (58) or different sizing of the outlet ports (58), the shape including equal shaping of the outlet ports (58) to one another or different shaping of the outlet ports (58) to one another.

Clause 10. The hydro-mechanical sounding device (50) of any one of clauses 4 to 9, wherein the one or more variables of at least one the strike face (62) and the second face are configured to tune one or more characteristics of the acoustic vibration.

Clause 11. The hydro-mechanical sounding device (50) of any one of clauses 1 to 10, wherein the strike face (62) comprises a first surface that is flat, contoured, collapsible, or coated; and wherein the second face comprises a second surface that is flat, ridged, or contoured.

Clause 12. The hydro-mechanical sounding device (50) of any one of clauses 1 to 11, wherein the housing (52) comprises a strike plate disposed in the chamber (54) and having the strike face (62).

Clause 13. The hydro-mechanical sounding device of any one of Clauses 1 to 13, wherein the piston is a final piston of a series; and wherein the series comprises one or more intermediate pistons disposed in the chamber between the at least one inlet and the final piston.

Clause 14. The hydro-mechanical sounding device of Clause 13, wherein a given one of the intermediate pistons is configured to strike the first face of the final piston or another one of the intermediate pistons and is configured to produce an intermediate acoustic vibration in response thereto.

Clause 15. The hydro-mechanical sounding device of Clause 1 to 14, wherein the chamber comprise a plurality of chamber portions, each of the chamber portions having one or more of the piston disposed therein.

Clause 16. The hydro-mechanical sounding device of Clause 15, wherein each of the chamber portions communicate with a separate one of the at least one inlet; or wherein each of the chamber portions communicate with a shared one of the at least one inlet.

Clause 17. An acoustic telemetry system used with a wellbore assembly (10) in a wellbore, the acoustic telemetry system comprising: at least one sounding device (50); at least one relay (30); and a receiver (25). For example, the acoustic telemetry system can comprise at least one sounding device (50) according to any one of claims 1 to 11 disposed in the wellbore. In another example, the at least one sounding device (50) disposed in the wellbore comprises a piston (60) and a striking surface (72) disposed in a chamber (54), the piston (60) being movable toward the striking surface (72) in response to hydraulic pressure communicated from the wellbore assembly (10) against the piston (60), the piston (60) being configured to produce an acoustic vibration in response to striking against the striking surface (72).

The at least one relay (30) is disposed in the wellbore proximate the at least one sounding device (50). The at least one relay (30) is configured to detect the acoustic vibration and is configured to electronically telemeter an acoustic signal in the wellbore in response to the detection of the acoustic vibration. The receiver (25) is configured to receive the acoustic signal telemetered from the at least one relay (30).

Clause 18. The acoustic telemetry system of clause 17, wherein: the at least one relay (30) has a relay (30) signal range, the at least one relay (30) being disposed within the relay (30) signal range of the at least one sounding device (50) or at least one other of the at least one relay (30); and the receiver (25) has a receiver (25) signal range, the receiver (25) being disposed within the receiver (25) signal range of the at least one relay (30).

Clause 19. The acoustic telemetry system of clause 17 or 18, wherein each of the at least one sounding devices (50) is associated with a downhole tool disposed on the wellbore assembly (10), the piston (60) being movable in response to the hydraulic pressure produced by an operation of the associated downhole tool.

Clause 20. The acoustic telemetry system of clause 17, 18 or 19, wherein the at least one sounding device (50) comprises a housing (52) defining the chamber (54) therein, the housing (52) defining an inlet port (56) communicating the chamber (54) with the wellbore assembly (10), the housing (52) defining at least one outlet port (58) communicating the chamber (54) with the wellbore, the chamber (54) having the striking surface (72) toward the outlet port (58).

Clause 21. The acoustic telemetry system of clause 20, wherein the piston (60) is movably disposed in the chamber (54) and has a piston face (63) and a strike face (62), the piston face (63) exposed toward the inlet port (56) of the chamber (54), the strike face (62) exposed toward the at least one outlet port (58) of the chamber (54), the piston (60) being movable from a first position proximate the inlet port (56) toward a second position against the striking surface (72) in response to a differential of the hydraulic pressure between the piston face (63) and the strike face (62), the strike face (62) of the piston (60) being configured to strike the striking surface (72) and configured to produce the acoustic vibration in response thereto.

Clause 22. The acoustic telemetry system of clause 21, wherein the striking surface (72) is flat, contoured, collapsible, or coated; and wherein the strike face (62) of the piston (60) is flat, ridged, or contoured.

Clause 23. The acoustic telemetry system of clause 21 or 22, wherein the housing (52) comprises a strike plate disposed in the chamber (54) and having the striking surface (72).

Clause 24. The acoustic telemetry system of clause 21, 22 or 23, comprising a retainer (66) temporarily retaining the piston (60) in the first position, the retainer (66) being configured to release the piston (60) to move toward the second position in response to a predetermined threshold of the differential of the hydraulic pressure.

Clause 25. The acoustic telemetry system of any one of clauses 21 to 24, wherein the piston (60) comprises seals sealing the piston (60) in the chamber (54).

Clause 26. The acoustic telemetry system of clause 21, wherein one or more variables of at least one of the chamber (54), the outlet port (58), the strike face (62), the piston (60), the striking surface (72), and the hydraulic pressure differential are configured to tune one or more characteristics of the acoustic vibration.

Clause 27. The acoustic telemetry system of clause 26, wherein the one or more characteristics of the acoustic vibration are selected from the group consisting of amplitude, frequency, tone, duration, pulsing, cadence, and proximity.

Clause 28. The acoustic telemetry system of clause 26 or 27, wherein the housing (52) defines a plurality of the at least one outlet port (58) disposed along a length of the chamber (54), the one or more variables of the plurality of the outlet ports (58) being configured to tune the one or more characteristics of the acoustic vibration.

Clause 29. The acoustic telemetry system of clause 28, wherein the one or more variable of the plurality of the outlet ports (58) comprises spacing between the outlet ports (58), the spacing including even spacing of the outlet ports (58) from one another along the length or varied spacing of the outlet ports (58) from one another along the length.

Clause 30. The acoustic telemetry system of clause 28 or 29, wherein the one or more variable of the outlet ports (58) comprises a size or a shape of the outlet ports (58), the size including equal sizing of the outlet ports (58) or different sizing of the outlet ports (58), the shape including equal shaping of the outlet ports (58) to one another or different shaping of the outlet ports (58) to one another.

Clause 31. The acoustic telemetry system of any one of clauses 26 to 30, wherein the one or more variables of at least one the striking surface (72) and the strike face (62) are configured to tune the one or more characteristics of the acoustic vibration.

Clause 32. The acoustic telemetry system of any one of clauses 17 to 31, wherein:

each of the at least one relay (30) comprises processing circuitry configured to:

detect one or more characteristics of the acoustic vibration; and electronically produce, based on the one or more characteristics detected, a predefined one of a plurality of acoustic signals; and the receiver (25) comprises processing circuitry configured to:

detect the predefined acoustic signal; and determine an indication of an event downhole based on the detection.

Clause 33. The acoustic telemetry system of any one of clauses 17 to 32, wherein:

each of the at least one relay (30) is configured to receive the acoustic vibration and electronically produce the acoustic signal reproducing one or more characteristics of the acoustic vibration; and the receiver (25) comprises processing circuitry configured to:

detect the one or more characteristics of the acoustic signal; and determine an indication of an event downhole based on the detection.

Clause 34. A method used with a wellbore assembly (10) in a wellbore, the method comprising: performing an operation downhole; moving, in response to hydraulic pressure from the operation, a piston (60) in a chamber (54) of a hydro-mechanical sounding device (50) disposed in the wellbore; producing an acoustic vibration by moving the piston in the chamber and/or striking a strike face (62) of the piston (60) moved against a striking surface (72) of the chamber (54); receiving the acoustic vibration at a relay (30) disposed in the wellbore proximate the hydro-mechanical sounding device (50); electronically producing an acoustic signal at the relay (30) in response to the acoustic vibration received; telemetering the acoustic signal to a receiver (25); and determining, based on the acoustic signal telemetered thereto, an indication of the operation at the receiver (25).

Clause 35. The method of clause 34, comprising temporarily retaining the piston (60) in a first position in the chamber (54); and releasing the piston (60) to move toward the striking surface (72) in response to a predetermined threshold of the hydraulic pressure.

Clause 36. The method of clause 34 or 35, comprising sealing the piston (60) in the chamber (54) with seals.

Clause 37. The method of clause 34, 35 or 36, wherein producing the acoustic vibration by striking the strike face (62) of the piston (60) moved against the striking surface (72) of the chamber (54) comprises tuning one or more characteristics of the acoustic vibration produced by the hydro-mechanical sounding device (50).

Clause 38. The method of clause 37, wherein tuning the one or more characteristics of the acoustic vibration produced by the hydro-mechanical sounding device (50) comprises configuring one or more variables of at least one of the chamber (54), an outlet port (58) of the chamber (54), the strike face (62), the piston (60), the striking surface (72), and the hydraulic pressure differential.

Clause 39. The method of clause 38, wherein the one or more characteristics of the acoustic vibration are selected from the group consisting of amplitude, frequency, tone, duration, cadence, and proximity.

Clause 40. The method of clause 37, 38 or 39, wherein tuning the one or more characteristics of the acoustic vibration produced by the hydro-mechanical sounding device (50) comprises defining a plurality of outlet ports (58) disposed along a length of the chamber (54), and configuring, based on the outlet ports (58), a strike force of the piston face (63) against the striking surface (72).

Clause 41. The method of any one of clauses 37 to 40, wherein tuning the one or more characteristics of the acoustic vibration produced by the hydro-mechanical sounding device (50) comprises expelling fluid from an outlet port (58) of the chamber (54) in response to movement of the piston (60); and producing the acoustic vibration with the expelled fluid.

Clause 42. The method of any one of clauses 37 to 41, wherein tuning the one or more characteristics of the acoustic vibration produced by the hydro-mechanical sounding device (50) comprises configuring the strike face (62) and the striking surface (72).

Clause 43. The method of any one of clauses 34 to 42, wherein performing the operation downhole comprises operating a downhole tool disposed on the wellbore assembly (10) proximate the hydro-mechanical sounding device (50).

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A hydro-mechanical sounding device used with a wellbore assembly in a wellbore, the hydro-mechanical sounding device comprising:

a housing defining a chamber therein, the housing defining at least one inlet port communicating the chamber with the wellbore assembly, the housing defining at least one outlet ports disposed along a length of the chamber, the outlet ports communicating the chamber with the wellbore, the chamber having a striking surface; and a piston disposed in the chamber and having first and second faces, the first face exposed toward the at least one inlet port of the chamber, the second face exposed toward the outlet ports of the chamber, the piston being movable from a first position proximate the at least one inlet port toward a second position against the striking surface in response to a hydraulic pressure differential between the first and second faces, the second face of the piston being configured to strike the striking surface and configured to produce an acoustic vibration in response thereto, wherein one or more first variables of the outlet ports are configured to tune one or more characteristics of the acoustic vibration.

2. The hydro-mechanical sounding device of claim 1, wherein the piston comprises one of:

a retainer temporarily retaining the piston in the first position, the retainer being configured to release the piston to move toward the second position in response to a predetermined threshold of the hydraulic pressure differential; and seals sealing the piston in the chamber.

3. The hydro-mechanical sounding device of claim 1, wherein the one or more first variables of the outlet ports comprise at least one of:

spacing between the outlet ports, the spacing including one of even spacing of the outlet ports from one another along the length and varied spacing of the outlet ports from one another along the length;

a size of the outlet ports, the size including one of equal sizing of the outlet ports and different sizing of the outlet ports; and a shape of the outlet ports, the shape including one of equal shaping of the outlet ports to one another and different shaping of the outlet ports to one another.

4. The hydro-mechanical sounding device of claim 1, wherein one or more second variables of at least one of the chamber, the striking surface, the piston, the second face, and the hydraulic pressure differential are configured to tune the one or more characteristics of the acoustic vibration.

5. The hydro-mechanical sounding device of claim 1, wherein the one or more characteristics of the acoustic vibration are selected from the group consisting of amplitude, frequency, tone, duration, pulsing, cadence, and proximity.

6. The hydro-mechanical sounding device of claim 4, wherein one of:

the chamber define one or more modifications disposed on a surface of the chamber, the one or more modifications as the one or more second variables being configured to tune the one or more characteristics of the acoustic vibration; and the one or more second variables of at least one of the striking surface and the second face are configured to tune the one or more characteristics of the acoustic vibration.

7. The hydro-mechanical sounding device of claim 1, wherein one of:

the striking surface comprises a first surface that is one of flat, contoured, collapsible, and coated;

the second face comprises a second surface that is one of flat, ridged, and contoured; and the housing comprises a strike plate disposed in the chamber and having the striking surface.

8. The hydro-mechanical sounding device of claim 1, wherein the chamber comprises a plurality of chamber portions, each of the chamber portions having one or more of the piston disposed therein.

9. The hydro-mechanical sounding device of claim 8, wherein one of:

each of the chamber portions communicates with a separate one of the at least one inlet port; and each of the chamber portions communicates with a shared one of the at least one inlet port.

10. The hydro-mechanical sounding device of claim 1, wherein the piston is a final piston of a series; and wherein the series comprises one or more intermediate pistons disposed in the chamber between the at least one inlet port and the final piston.

11. The hydro-mechanical sounding device of claim 10, wherein a given one of the intermediate pistons is configured to strike the first face of one of the final piston and another one of the intermediate pistons and is configured to produce an intermediate acoustic vibration in response thereto.

12. An acoustic telemetry system used with the wellbore assembly in the wellbore, the acoustic telemetry system comprising:

at least one sounding device according to claim 1 disposed in the wellbore;

at least one relay disposed in the wellbore proximate the at least one sounding device, the at least one relay being configured to detect the acoustic vibration and being configured to electronically telemeter an acoustic signal in the wellbore in response to the detection of the acoustic vibration; and a receiver being configured to receive the acoustic signal telemetered from the at least one relay.

13. The acoustic telemetry system of claim 12, wherein each of the at least one sounding device is associated with an associated downhole tool disposed on the wellbore assembly, the piston being movable in response to the hydraulic pressure differential produced by an operation of the associated downhole tool.

14. The acoustic telemetry system of claim 12, wherein one of:

(i)(a) each of the at least one relay comprises processing circuitry configured to detect the one or more characteristics of the acoustic vibration and electronically produce, based on the one or more characteristics detected, a predefined one of a plurality of acoustic signals as a predefined acoustic signal; and (b) the receiver comprises processing circuitry configured to detect the predefined acoustic signal and determine an indication of an event downhole based on the detection; and (ii)(a) each of the at least one relay is configured to receive the acoustic vibration and electronically produce the acoustic signal reproducing the one or more characteristics of the acoustic vibration, and (b) the receiver comprises processing circuitry configured to detect the one or more characteristics of the acoustic signal and determine the indication of the event downhole based on the detection.

15. A hydro-mechanical sounding device used with a wellbore assembly in a wellbore, the hydro-mechanical sounding device comprising:

a housing defining a chamber therein, the housing defining at least one inlet port communicating the chamber with the wellbore assembly, the housing defining at least one outlet port communicating the chamber with the wellbore, the chamber having a striking surface toward the at least one outlet port; and a series of pistons disposed in the chamber, the pistons of the series comprising a final piston and comprising one or more intermediate pistons disposed in the chamber between the at least one inlet port and the final piston, each of the pistons having first and second faces, the first face exposed toward the at least one inlet port of the chamber, the second face exposed toward the at least one outlet port of the chamber, the final piston being movable from a first position proximate the at least one inlet port toward a second position against the striking surface in response to a hydraulic pressure differential between the first and second faces, the second face of the final piston being configured to strike the striking surface and configured to produce an acoustic vibration in response thereto.

16. The hydro-mechanical sounding device of claim 15, wherein a given one of the intermediate pistons is configured to strike the first face of one of the final piston and another one of the intermediate pistons and is configured to produce an intermediate acoustic vibration in response thereto.

17. The hydro-mechanical sounding device of claim 15, wherein the chamber comprise a plurality of chamber portions, each of the chamber portions having one or more of the pistons disposed therein.

18. The hydro-mechanical sounding device of claim 17, wherein one of:

each of the chamber portions communicates with a separate one of the at least one inlet port; and each of the chamber portions communicates with a shared one of the at least one inlet port.

19. The hydro-mechanical sounding device of claim 15, wherein one of:

the striking surface comprises a first surface that is one of flat, contoured, collapsible, and coated;

the second face of the final piston comprises a second surface that is one of flat, ridged, and contoured; and the housing comprises a strike plate disposed in the chamber and having the striking surface.

20. The hydro-mechanical sounding device of claim 15, wherein one or more variables of at least one of the chamber, the at least one outlet port, the striking surface, one or more of the pistons, the second face of one or more of the pistons, and the hydraulic pressure differential are configured to tune one or more characteristics of the acoustic vibration.

21. The hydro-mechanical sounding device of claim 20, wherein one of:

the one or more characteristics of the acoustic vibration are selected from the group consisting of amplitude, frequency, tone, duration, pulsing, cadence, and proximity;

the chamber defines one or more modifications disposed on a surface of the chamber, the one or more modifications as the one or more variables being configured to tune the one or more characteristics of the acoustic vibration;

the housing defines a plurality of the at least one outlet port disposed along a length of the chamber, the one or more variables of the outlet ports being configured to tune the one or more characteristics of the acoustic vibration; and the one or more variables of at least one of the striking surface and the second face of the final piston are configured to tune the one or more characteristics of the acoustic vibration.

22. The hydro-mechanical sounding device of claim 15, wherein the final piston comprises one of:

a retainer temporarily retaining the final piston in the first position, the retainer being configured to release the final piston to move toward the second position in response to a predetermined threshold of the hydraulic pressure differential; and seals sealing the final piston in the chamber.

23. An acoustic telemetry system used with the wellbore assembly in the wellbore, the acoustic telemetry system comprising:

at least one sounding device according to claim 15 disposed in the wellbore;

at least one relay disposed in the wellbore proximate the at least one sounding device, the at least one relay being configured to detect the acoustic vibration and being configured to electronically telemeter an acoustic signal in the wellbore in response to the detection of the acoustic vibration; and a receiver being configured to receive the acoustic signal telemetered from the at least one relay.

24. The acoustic telemetry system of claim 23, wherein each of the at least one sounding device is associated with an associated downhole tool disposed on the wellbore assembly, the final piston being movable in response to the hydraulic pressure differential produced by an operation of the associated downhole tool.

25. The acoustic telemetry system of claim 23, wherein one of:

(i))(a) each of the at least one relay comprises processing circuitry configured to detect one or more characteristics of the acoustic vibration and electronically produce, based on the one or more characteristics detected, a predefined one of a plurality of acoustic signals as a predefined acoustic signal; and (b) the receiver comprises processing circuitry configured to detect the predefined acoustic signal and determine an indication of an event downhole based on the detection; and (ii)(a) each of the at least one relay is configured to receive the acoustic vibration and electronically produce the acoustic signal reproducing the one or more characteristics of the acoustic vibration, and (b) the receiver comprises processing circuitry configured to detect the one or more characteristics of the acoustic signal and determine the indication of the event downhole based on the detection.

* * * * *